US008344967B2

(12) United States Patent
Kim et al.

(10) Patent No.: US 8,344,967 B2
(45) Date of Patent: Jan. 1, 2013

(54) PLASMA DISPLAY APPARATUS

(75) Inventors: Seokho Kim, Gyoungsangbuk-do (KR); Hyungjae Kim, Gyoungsangbuk-do (KR); Donghyun Park, Gyoungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 818 days.

(21) Appl. No.: 12/487,705

(22) Filed: Jun. 19, 2009

(65) Prior Publication Data

US 2010/0053037 A1 Mar. 4, 2010

(30) Foreign Application Priority Data

Aug. 29, 2008 (KR) ..... 10-2008-0084950

(51) Int. Cl.
*G09G 3/28* (2006.01)

(52) U.S. Cl. ..... 345/60

(58) Field of Classification Search ..... 345/60
See application file for complete search history.

(56) References Cited

U.S. PATENT DOCUMENTS

| | | | | |
|---|---|---|---|---|
| 2005/0029953 | A1* | 2/2005 | Kwak et al. | 315/86 |
| 2006/0232512 | A1* | 10/2006 | Kim | 345/60 |
| 2006/0262044 | A1* | 11/2006 | Lee et al. | 345/68 |
| 2007/0236415 | A1* | 10/2007 | Jung et al. | 345/60 |
| 2008/0191970 | A1* | 8/2008 | Rhee | 345/60 |

* cited by examiner

*Primary Examiner* — Alexander S Beck
*Assistant Examiner* — Joseph Pena
(74) *Attorney, Agent, or Firm* — Fish & Richardson P.C.

(57) ABSTRACT

A plasma display apparatus is disclosed. The plasma display apparatus includes a plasma display panel that includes a scan electrode, a sustain electrode, and a data electrode; and a scan driver that supplies the scan electrode with a first driving voltage serving as a reference voltage, a second driving voltage supplied from a single voltage source, and a third driving voltage that has the same magnitude as that of the second driving voltage and has the opposite polarity of that of the second driving voltage.

8 Claims, 6 Drawing Sheets

PLASMA DISPLAY APPARATUS

This application claims the benefit of Korean Patent Application No. 10-2008-0084950 filed on Aug. 29, 2008, which is hereby incorporated by reference.

BACKGROUND OF THE DISCLOSURE

1. Field of the Disclosure

This document is directed to a plasma display apparatus.

2. Description of the Background Art

A plasma display apparatus includes a plasma display panel and a driver. The plasma display panel includes discharge cells, each of which is partitioned from the others by barrier walls. When the driver supplies a driving signal to electrodes of the plasma display panel, a discharge occurs at a discharge cell in response to the driving signal, and when the discharge excites the phosphor within the discharge cell, the phosphor emits light.

A plasma display apparatus expresses a gray level based on a combination of subfields. That is, the plasma display apparatus externally emits light during each subfield and a gray scale is represented according to a mixture of light externally emitted during each subfield.

Each subfield includes a reset period, an address period, and a sustain period. During a reset period, wall charges are uniformly created at the whole discharge cells of the display panel. A discharge cell, which will emit light, is selected during an address period. Light is emitted from the selected discharge cell during a sustain period.

Meanwhile, it becomes a critical issue to reduce costs of manufacturing the driver of flat display apparatus as its competence is overheated. Korean Patent Application Publication Nos. 2007-0106329, 2006-0121020, 2006-0121019, and 2006-0119582 disclose simplifying the circuit of driver.

SUMMARY OF THE DISCLOSURE

The plasma display apparatus includes a plasma display panel configured to include a scan electrode, a sustain electrode, and a data electrode; and a scan driver configured to supply the scan electrode with a first driving voltage serving as a reference voltage, a second driving voltage supplied from a single voltage source, and a third driving voltage that has the same magnitude as that of the second driving voltage and has the opposite polarity of that of the second driving voltage, wherein the scan driver includes an energy recovery circuit configured to supply or recover a charged voltage, a first signal generator configured to generate the second driving voltage and a set-up signal gradually rising up to double of the second driving voltage, a second signal generator configured to generate the first driving voltage, and generate a set-down signal gradually falling to the third driving voltage and a scan signal falling to the third driving voltage, a voltage supplier configured to supply the second driving voltage, the third driving voltage, and double of the second driving voltage through the first signal generator or the second signal generator, a scan driver configured to supply a scan electrode with a driving signal generated from the energy recovery circuit, the first signal generator, and the second signal generator, and a switching unit configured to allow a voltage provided from the voltage supplier to be supplied to the first signal generator or the second signal generator.

The energy recovery circuit may supply a voltage charged to an energy storage capacitor through a first switch and an inductor, and charge the energy storage capacitor through the inductor and a second switch.

The first signal generator may include a first switch connected to a voltage source supplying the second driving voltage, wherein the first switch generates a signal sharply varying or a signal gradually varying.

The first switch may generate a signal sharply varying as being supplied with a turn-on control signal through a first input terminal and a signal gradually varying as being supplied with a turn-on control signal through a second input terminal.

A slope of the signal gradually varying may change with the magnitude of a variable resistor connected to the second input terminal.

The second signal generator may include a second switch that receives the first driving voltage and is connected to the scan driver.

The second switch may generate a signal sharply varying as being supplied with a turn-on control signal through a third input terminal and a signal gradually varying as being supplied with a turn-on control signal through a fourth input terminal.

A slope of the signal gradually varying may change with the magnitude of a variable resistor connected to the fourth input terminal.

The voltage supplier may include a capacitor that is connected to the first signal generator and the second signal generator.

The scan driver may supply the scan electrode with a driving signal generated from the energy recovery circuit, the first signal generator, and the second signal generator through a top switch or a bottom switch.

The switching unit may include a first path switch connected between the first signal generator and the voltage supplier, a second path switch connected between the second signal generator and the voltage supplier, and a third path switch connected between the voltage supplier and a common terminal of the second path switch and the second signal generator.

A voltage source supplying the second driving voltage, a first path switch of the switching unit, the voltage supplier, a third path switch of the switching unit, and a second switch of the second signal generator may be connected to each other and the second switch, the third path switch, and a bottom switch of the scan driver may be connected to each other.

A second switch of the second signal generator, a second path switch of the switching unit, the voltage supplier, and a bottom switch of the scan driver may be connected to each other.

A voltage source supplying the second driving voltage, a first switch of the first signal generator, and a bottom switch of the scan driver may be connected to each other.

A second switch of the second signal generator, a third path switch of the switching unit, and the voltage supplier may be connected to each other.

A voltage source supplying the second driving voltage, a first switch of the first signal generator, the voltage supplier, a second path switch of the switching unit, and a top switch of the scan driver may be connected to each other.

A second switch of the second signal generator, a third path switch of the switching unit, and a bottom switch of the scan driver may be connected to each other.

A second switch of the second signal generator and a top switch of the scan driver may be connected to each other.

An energy storage capacitor, a first switch, and an inductor of the energy recovery circuit, and a bottom switch of the scan driver may be connected to each other, a voltage source supplying the second driving voltage, a first switch of the first signal generator, and the bottom switch of the scan driver may be connected to each other, the bottom switch of the scan driver, and the inductor, a second switch, and the energy storage capacitor of the energy recovery circuit may be connected to each other, and a second switch of the second signal generator and a top switch of the scan driver may be connected to each other.

DETAILED DESCRIPTION OF EMBODIMENTS

Hereinafter, exemplary embodiments will be described with reference to accompanying drawings. Other advantages, features, and accomplishments thereof will be apparent from the exemplary embodiments that will be detailed below with reference to accompanying drawings.

Figure 1:
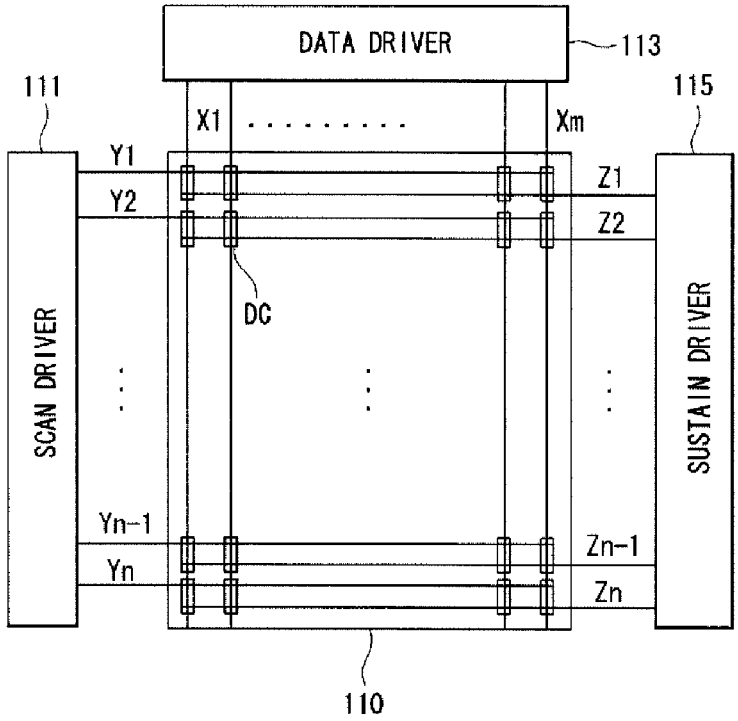
FIG. 1 illustrates a plasma display apparatus according to an exemplary embodiment.
Figure 2:
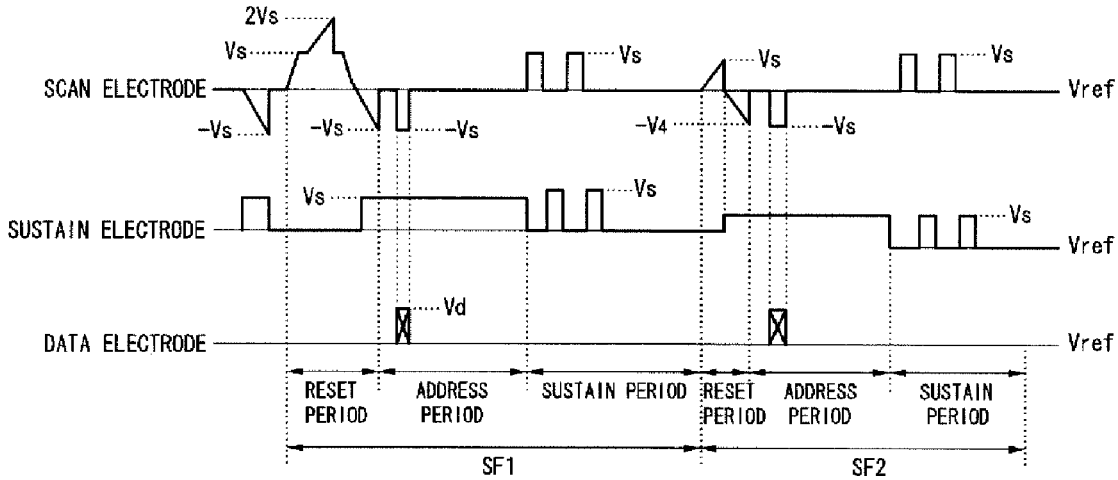
FIG. 2 illustrates a driving signal of a plasma display apparatus according to an exemplary embodiment.

FIG. 1 illustrates a plasma display apparatus according to an exemplary embodiment, and FIG. 2 illustrates a driving signal of a plasma display apparatus according to an exemplary embodiment.

Referring to FIG. 1, a plasma display apparatus according to an exemplary embodiment includes a plasma display panel 110, a scan driver 111, a data driver 113, and a sustain driver 115.

The plasma display panel 110 includes scan electrodes Y1 to Yn and sustain electrodes Z1 to Zn that are parallel with each other, and data electrodes X1 to Xm that intersect the scan electrodes Y1 to Yn and the sustain electrodes Z1 to Zn. Discharge cells (DCs) correspond to intersections between the data electrodes X1 to Xm, and the scan electrodes Y1 to Yn and the sustain electrodes Z1 to Zn.

The scan driver 111 supplies a scan electrode with a second driving voltage Vs provided from one voltage source as a driving signal.

Referring to FIG. 2, a pre-reset signal gradually falling from a first driving voltage Vref to a third driving voltage −Vs is supplied to a scan electrode during a pre-reset period. At this time, the third driving voltage −Vs is equal in magnitude to the second driving voltage Vs but has the opposite polarity of that of the second driving voltage Vs. And, the sustain driver 115 supplies a sustain electrode with a signal sharply rising up to the second driving voltage Vs. The scan driver 111 may supply a scan electrode with a falling ramp pulse during a pre-reset period and the sustain driver 115 may supply a rising square pulse to a sustain electrode during the same period. Such supply of the pre-reset signal during the pre-reset period causes wall charges to be created within the discharge cell by a potential difference between the scan electrode and the sustain electrode. Since wall charges may be generated during the pre-reset period, the peak voltage of a set-up signal may be reduced during a reset period.

The scan driver 111 supplies a scan electrode with a set-up signal that gradually rises from the first driving voltage Vref to the second driving voltage Vs and then gradually rises from the second driving voltage Vs to double of the second driving voltage 2 Vs during a reset period as shown in FIG. 2.

The first driving voltage Vref may be a ground voltage. Wall charges are sufficiently created at the entire discharge cells of the plasma display panel 110 as the set-up signal is supplied.

The slope of the set-up signal rising form the first driving voltage Vref to the second driving voltage Vs may be different from that of the set-up signal rising from the second driving voltage Vs to double of the second driving voltage 2 Vs. Accordingly, it is possible to supply a set-up signal to fit for the features of the plasma display panel.

In particular, the slope of the set-up signal rising form the first driving voltage Vref to the second driving voltage Vs may be greater than that of the set-up signal rising from the second driving voltage Vs to double of the second driving voltage 2 Vs. A weak dark discharge occurs around the peak voltage of the set-up signal during the reset period. Accordingly, when the voltage at the scan electrode rises during a short time from the first driving voltage Vref to the second driving voltage Vs, sufficient wall charges may be created at the discharge cell, whereas when the voltage at the scan electrode rises during a relatively long time from the second driving voltage Vs to double of the second driving voltage 2 Vs, the amount of light emitted by the dark discharge may be decreased. This leads to improvement in contrast ratio.

After supply of the set-up signal, the scan driver 111 supplies a scan electrode with a set-down signal that gradually falls down to the third driving voltage −Vs having the same magnitude as that of the second driving voltage Vs. The supply of set-down signal causes the wall charges generated at the discharge cells to be partially eliminated, thus wall charges are uniformly created at the entire discharge cells.

The scan driver 111 supplies a scan electrode with a scan signal that falls from the first driving voltage Vref to the third driving voltage −Vs during an address period. That is, the first driving voltage Vref is supplied as a scan reference voltage and it is supplied the third driving voltage −Vs that has the same magnitude as that of the second driving voltage Vs and opposite polarity of that of the second driving voltage Vs as the lowest voltage of the scan signal. The data driver 113 supplies a data electrode with a data signal rising up to the data voltage Vd while the scan signal is supplied.

As the scan signal and data signal are supplied, there are selected discharge cells that will emit light during a sustain period.

The sustain driver 115 supplies a sustain electrode with a sustain bias signal rising up to the second driving voltage Vs while the set-down signal and scan signal are supplied. As the sustain bias signal is supplied, an address discharge may smoothly occur to select discharge cells.

The scan driver 111 and the sustain driver 115 alternately supply a scan electrode and a sustain electrode with a sustain signal rising from the first driving voltage Vref to the second driving voltage Vs during a sustain period. The supply of sustain signal enables light to be emitted from discharge cells selected during the address period.

The plasma display apparatus according to an exemplary embodiment may generate a driving signal with a single voltage source that supplies the second driving voltage Vs. Accordingly, the structure of plasma display apparatus may be simplified and manufacturing costs may be reduced. The single voltage source may be mounted in the plasma display apparatus, or provided outside the plasma display apparatus to supply the second driving voltage Vs.

Referring to FIG. 2, it may be possible to supply a scan electrode with a set-up signal gradually rising from the first driving voltage Vref to the second driving voltage Vs during a reset period of the second subfield SF2. Since wall charges are sufficiently existent in the discharge cells thanks to supply of the set-up signal rising up to double of the second driving voltage (2 Vs) during the first subfield SF1 prior to the second subfield SF2, address discharge and sustain discharge may take place in a stable manner even though it is supplied a set-up signal that rises up to the second driving voltage Vs during the second subfield SF2.

After supply of the set-up signal, the scan driver 111 may supply a scan electrode with a set-down signal falling down to a fourth driving voltage −Vs that is lower than the first driving voltage Vref and higher than the third driving voltage −Vs. According to supply of the set-down signal falling to the fourth driving voltage −V4 higher than the third driving voltage −Vs, the amount of wall charges created at the discharge cells, which will be eliminated, may be controlled.

The driving signal supplied during an address period and a sustain period of the second subfield SF2 is identical to the driving signal supplied during the first subfield SF1, and thus, the detailed descriptions will be omitted. Although it has been described in the exemplary embodiment that the first subfield SF1 abuts the second subfield SF2, both may be apart from each other.

Figure 3:
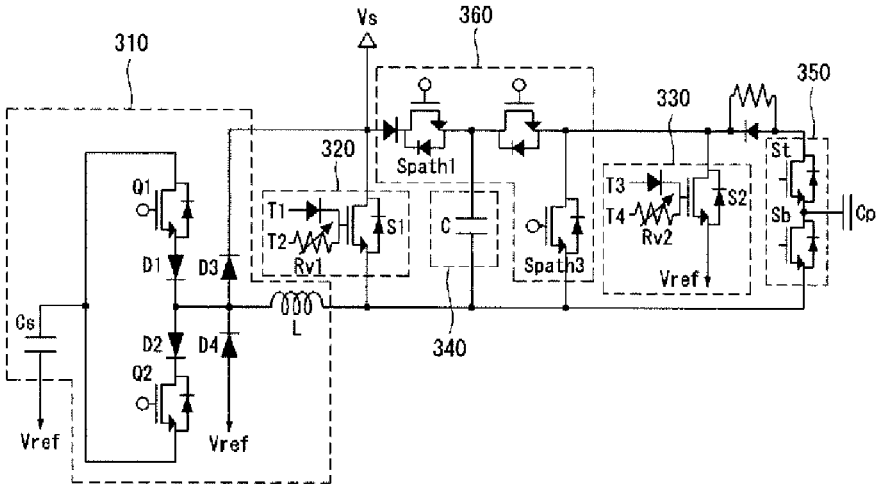
FIG. 3 illustrates a circuit diagram of the scan driver shown in FIG. 1.

FIG. 3 is a circuit diagram illustrating the scan driver shown in FIG. 1. Referring to FIG. 3, the scan driver includes an energy recovery circuit 310, a first signal generator 320, a second signal generator 330, a voltage supplier 340, a scan driver 350, and a switching unit 360.

The energy recovery circuit 310 supplies a voltage charged at an energy storage capacitor Cs through a first switch Q1 and an inductor L, and electrically charges the energy storage capacitor Cs through the inductor L and a second switch Q2. While the energy recovery circuit 310 supplies or recovers a charged voltage, the inductor L makes resonance with the plasma display panel Cp. A first diode D1 and a second diode D2 block a current flowing from the cathode to the anode. A third diode D3 clamps a voltage higher than the second driving voltage Vs, and a fourth diode D4 clamps a voltage lower than the first driving voltage Vref.

The first signal generator 320 supplies the second driving voltage Vs and generates a set-up signal gradually rising up to the second driving voltage Vs or double of the second driving voltage 2 Vs. The first signal generator 320 includes a first switch S1 connected to a voltage source supplying the second driving voltage Vs. The first switch S1 generates a signal sharply varying when a turn-on control signal is supplied through a first input terminal T1 and a signal gradually varying when a turn-on control signal is supplied through a second input terminal T2. The slope of the signal gradually varying changes with the magnitude of a variable resistor Rv1 connected to the second input terminal T2.

The second signal generator 330 does not only generate the first driving voltage Vref but also a set-down signal gradually falling to the third driving voltage −Vs and a scan signal falling to the third driving signal −Vs. The second signal generator 330 includes a second switch S2 that receives the first driving voltage Vref and is connected to the scan driver 350. The second switch S2 generates a signal sharply varying when a turn-on control signal is supplied through a third input terminal T3 and a signal gradually varying when a turn-on control signal is supplied through a fourth input terminal T4. The slope of the signal gradually varying changes with the magnitude of a variable resistor Rv2 connected to the fourth input terminal T4.

The voltage supplier 340 supplies the second driving voltage Vs, the third driving voltage −Vs, and double 2 Vs of the second driving voltage through the first signal generator 320 or the second signal generator 330. The voltage supplier 340 includes a capacitor C that is connected to the first signal generator 320 and the second signal generator 330.

The scan driver 350 supplies a driving signal generated from the energy recovery circuit 310, the first signal generator 320, and the second signal generator 330 to a scan electrode through a top switch St or a bottom switch Sb.

The switching unit 360 allows a voltage provided from the voltage supplier 340 to be supplied to the first signal generator 320 or the second signal generator 330. For this purpose, the switching unit 360 includes a first path switch Spath1 connected between the first signal generator 320 and the voltage supplier 340, a second path switch Spath2 connected between the second signal generator 330 and the voltage supplier 340, and a third path switch Spath3 connected between a common terminal of the second path switch Spath2 and the second signal generator 330 and the voltage supplier 340.

Hereinafter, the operation of the scan driver will be described in detail with reference to drawings.

Figure 4A:
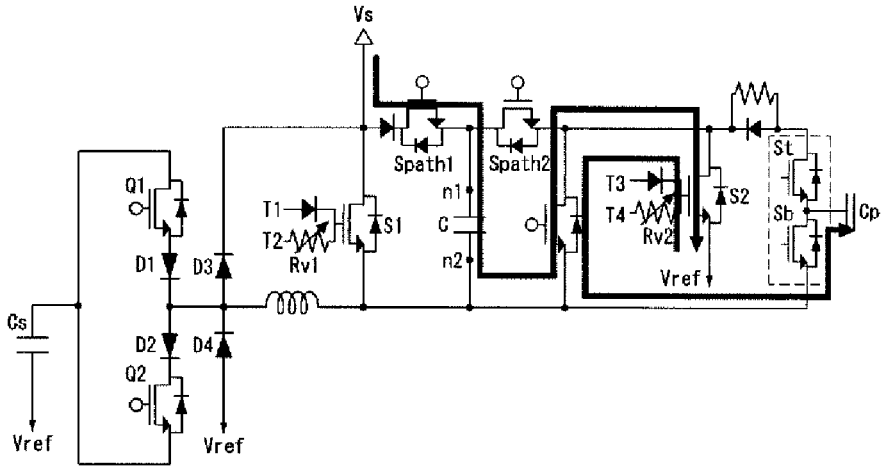
FIGS. 4A to 4M illustrate the operation of the scan driver shown in FIG. 1.

Referring to FIG. 4A, the voltage source supplying the second driving voltage Vs, the first path switch Spath1 of the switching unit 360, the voltage supplier 340, the third path switch Spath3 of the switching unit 360, and the second switch S2 of the second signal generator 330 are connected to each other, and the second switch S2, the third path switch Spath3, and the bottom switch Sb of the scan driver 350 are connected to each other. Prior to supply of a pre-reset signal, the first path switch Spath1, the third path switch Spath3, and the second switch S2 are turned on electrically. The capacitor C is charged with the second driving voltage Vs. Accordingly, the voltage at node n1 becomes the second driving voltage Vs, and the voltage at node n2 becomes the first driving voltage Vref. Further, a turn-on control signal is supplied through the third input terminal T3 of the second switch S2 so that the first driving voltage Vref is supplied to a scan electrode through the bottom switch Sb.

Figure 4B:
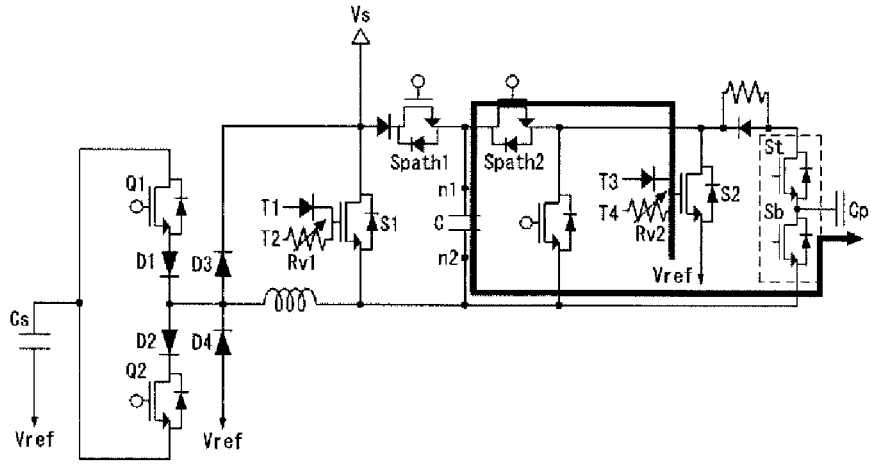

Referring to FIG. 4B, the second switch S2 of the second signal generator 330, the second path switch Spath2 of the switching unit 360, the voltage supplier 340, and the bottom switch Sb of the scan driver 350 are connected to each other. When a turn-on control signal is inputted through the fourth input terminal T4 of the second switch S2, the second switch S2 turns on. And, the second path switch Spath2 and the bottom switch Sb are also turned on. Accordingly, the first driving voltage Vref is supplied to the node n1 and the third driving voltage −Vs is supplied to the node n2 since the second driving voltage Vs is charged to the capacitor C. At this time, the second switch S2 is operated in an active region and thus the voltage at the scan electrode is gradually decreased from the first driving voltage Vref to the third driving voltage −Vs, so that a pre-reset signal is supplied to a scan electrode. Even though it has been described in the exemplary embodiment that a signal has been supplied to a scan electrode and a sustain electrode during the pre-reset period, the signal could be adapted not to be supplied.

Figure 4C:
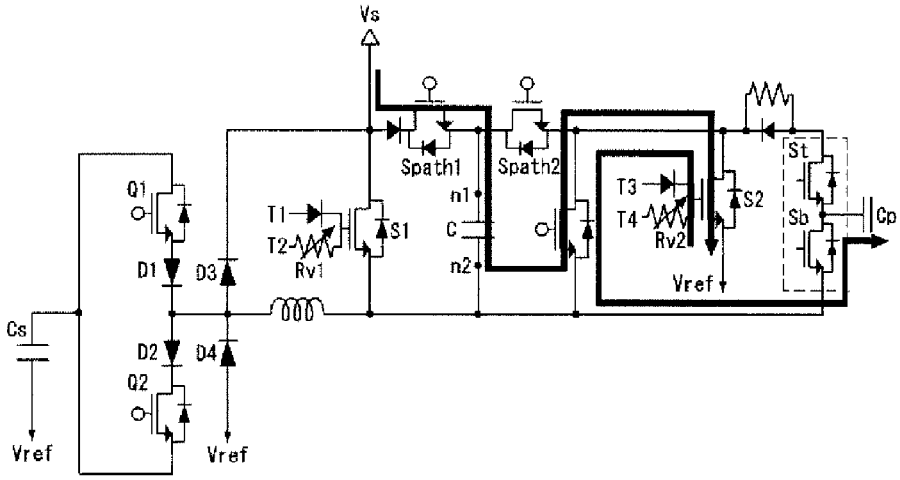

Referring to FIG. 4C, the same connection as that shown in FIG. 4A is made. Prior to supply of a set-up signal after a pre-reset signal has been supplied, the first path switch Spath1, the third path switch Spath3, and the second switch S2 are turned on so that the voltage at node n1 becomes the second driving voltage Vs and the voltage at node n2 becomes the first driving voltage Vref. Further, a turn-on control signal is supplied through the third input terminal T3 of the second switch S2 so that the first driving voltage Vref is supplied to a scan electrode through the bottom switch Sb.

Figure 4D:
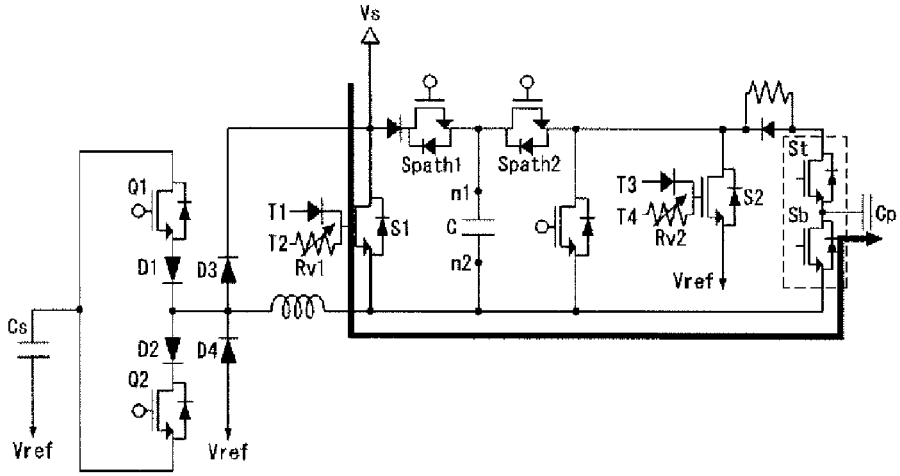

Referring to FIG. 4D, the voltage source supplying the second driving voltage Vs, the first switch S1 of the first signal generator 320, and the bottom switch Sb of the scan driver 350 are connected to each other. When a switch turn-on signal is supplied through the second input terminal T2 of the first switch S1, the first switch S1 is operated in an active region. Accordingly, a set-up signal gradually rising from the first driving voltage Vref to the second driving voltage Vs during the reset period shown in FIG. 2 is supplied to a scan electrode through the bottom switch Sb turned on.

Figure 4E:
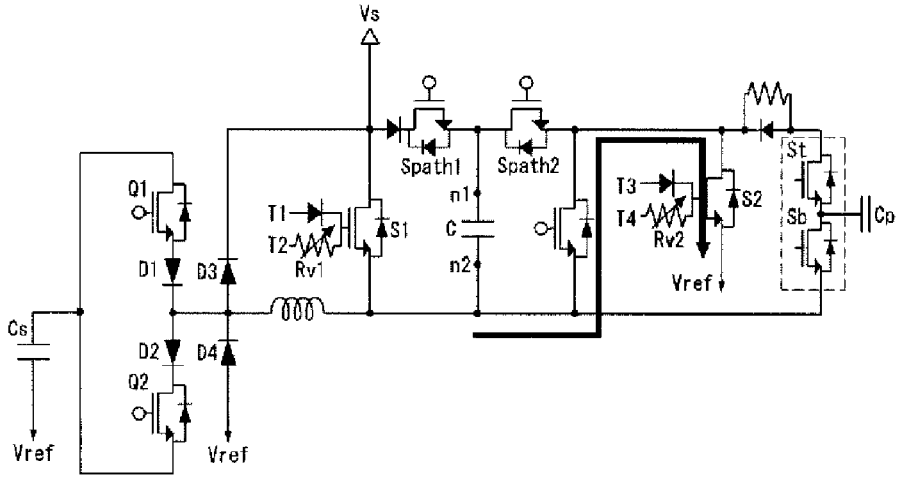

Referring to FIG. 4E, the second switch S2 of the second signal generator 330, the third path switch Spath3 of the switching unit 360, and the voltage supplier 340 are connected to each other. After supply of the set-up signal, a turn-on control signal is supplied through the third input terminal T3 of the second switch S2, and thus, the second switch S2 is turned on so that the first driving voltage Vref is supplied to the node n2 through a bi-diode of the third path switch Spath3. At this time, since the switches St and Sb of the scan driver 350 are turned off, the voltage at the scan electrode is maintained as the second driving voltage Vs.

Figure 4F:
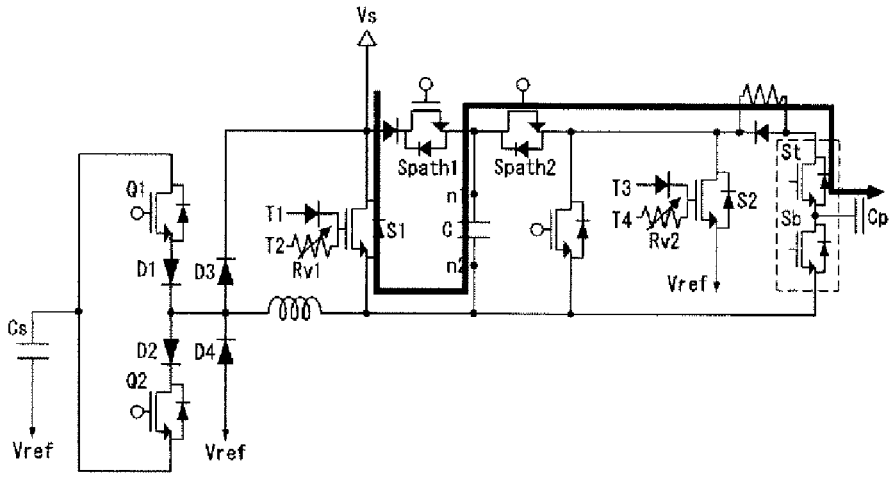

Referring to FIG. 4F, the voltage source supplying the second driving voltage Vs, the first switch S1 of the first signal generator 320, the voltage supplier 340, the second path switch Spath2 of the switching unit 360, and the top switch St of the scan driver 350 are connected to each other. When a switch turn-on signal is supplied through the second input terminal T2 of the first switch S1, the first switch S1 operates at an active region. Further, the second path switch Spath2 and the top switch St are turned on. Accordingly, the voltage at node n2 of the capacitor C gradually rises up to the second driving voltage V2 and the voltage at node n1 of the capacitor C gradually rises from the second driving voltage Vs to double 2 Vs of the second driving voltage Vs since the capacitor C is electrically charged with the second driving voltage Vs. As a consequence, a set-up signal is supplied through the scan driver 350, which gradually rises from the second driving voltage Vs to double 2 Vs of the second driving voltage Vs as shown in FIG. 2.

At this time, the slope of the set-up signal gradually rising from the first driving voltage Vref to the second driving voltage Vs and the slope gradually rising from the second driving voltage Vs to double 2 Vs of the second driving voltage Vs vary with the variable resistor Rv1. Accordingly, as the magnitude of the variable resistor is controlled, the slope of the set-up signal may be controlled correspondingly.

Figure 4G:
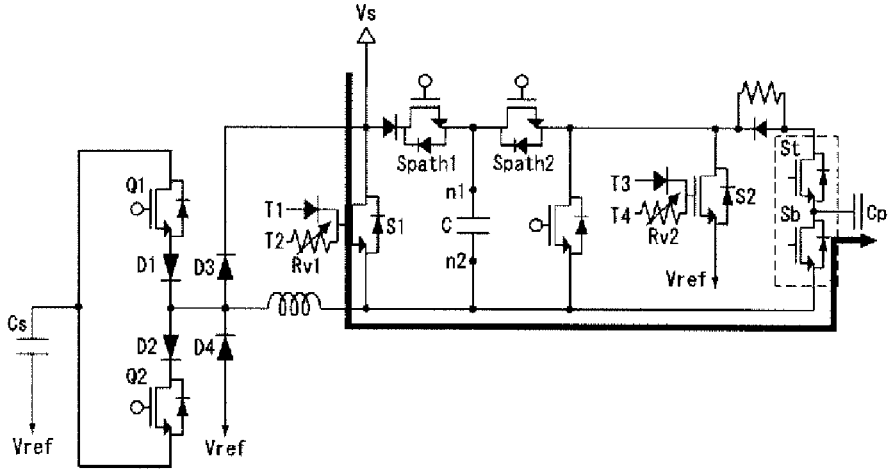

Referring to FIG. 4G, the same connection as shown in FIG. 4D is made. When the bottom switch Sb turns on and a switch turn-on signal is supplied through the first input terminal T1 of the first switch S1, the voltage of scan electrode sharply drops from double 2 Vs of the second driving voltage Vs to the second driving voltage Vs.

When a turn-on control signal is supplied through the first input terminal T1 after supply of the set-up signal and the bottom switch Sb turns on, the voltage of scan electrode sharply falls from double 2 Vs of the second driving voltage Vs to the second driving voltage Vs.

Figure 4H:
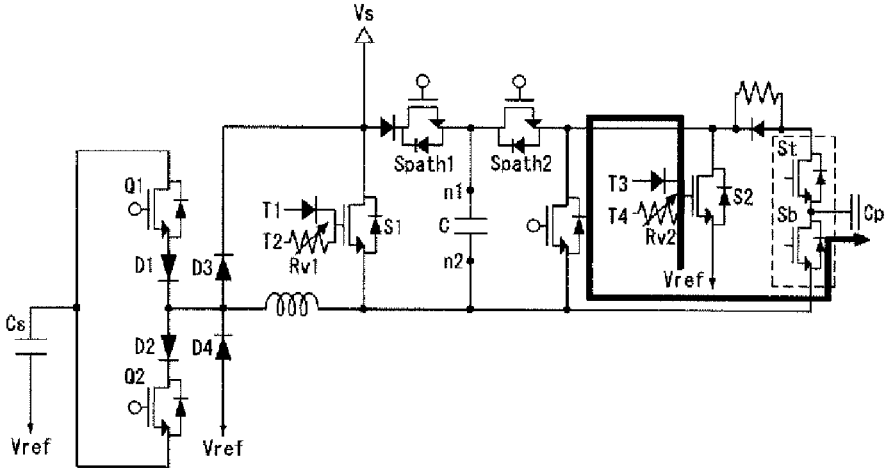

Referring to FIG. 4H, the second switch S2 of the second signal generator 330, the third path switch Spath3 of the switching unit 360, and the bottom switch Sb of the scan driver 350 are connected to each other. When a turn-on control signal is inputted through the fourth input terminal T4 of the second switch S2, the second switch S2 turns on. The third path switch Spath3 and the bottom switch Sb also turn on. Accordingly, the second switch S2 operates at an active region, and thus, a set-down signal gradually falling from the second driving voltage Vs to the first driving voltage Vref is supplied as the voltage of scan electrode.

Figure 4I:
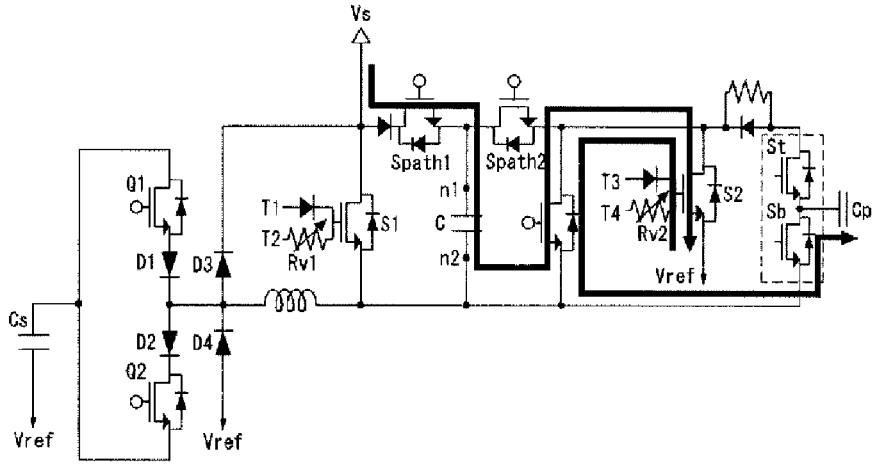

Referring to FIG. 4I, the same connection as shown in FIGS. 4A and 4C is made. The first path switch Spath1, the third path switch Spath3, and the second switch S2 are turned on so that the capacitor C is electrically charged with the second driving voltage Vs. At this time, the second switch S2 is supplied with a turn-on control signal through the third input terminal T3. Accordingly, the first driving voltage Vref is supplied to a scan electrode through the bottom switch Sb.

Figure 4J:
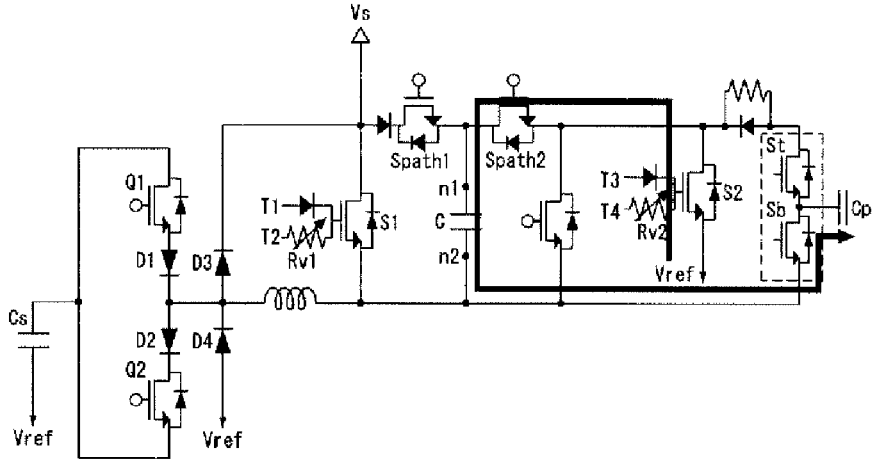

Referring to FIG. 4J, the same connection as shown in FIG. 4B is made. When a turn-on control signal is inputted through the fourth input terminal T4 of the second switch S2, the second switch S2 is turned on. The second path switch Spath2 and the bottom switch Sb also turn on. At this time, since the second switch S2 operates at an active region, a set-down signal gradually falling from the first driving voltage Vref to the third driving voltage −Vs is supplied as the voltage of scan electrode.

Figure 4K:
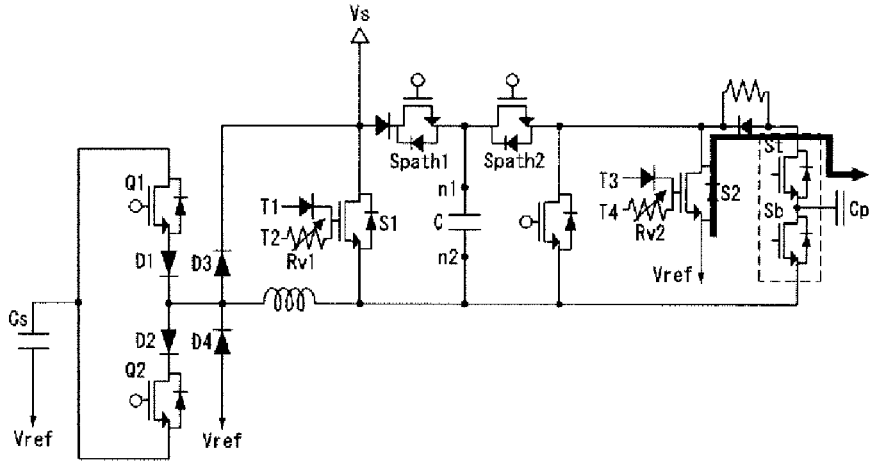

Referring to FIG. 4K, the second switch S2 of the second signal generator 330 and the top switch St of the scan driver 350 are connected to each other. As the top switch St turns on, a turn-on control signal is inputted through the third input terminal T3 of the second switch S2. Accordingly, the voltage of scan electrode sharply rises from the third driving voltage −Vs to the first driving voltage Vref during the address period as shown in FIG. 2. At this time, the first driving voltage supplied corresponds to the scan reference voltage.

Figure 4L:
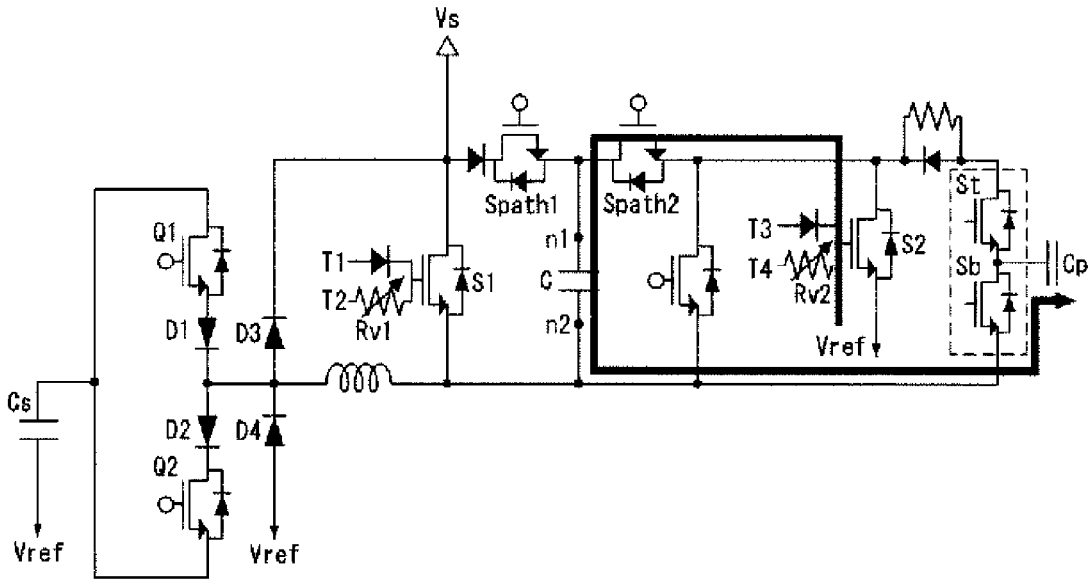

Referring to FIG. 4L, the same connection as shown in FIGS. 4B and 4J is made. As the bottom switch Sb and the second path switch Spath2 turn on, a turn-on control signal continues to be inputted through the third input terminal T3 of the second switch S2. Accordingly, the first driving voltage Vref is supplied to the node n1 and the third driving voltage −Vs is supplied to the node n2 since the capacitor C is charged with the second driving voltage Vs. Therefore, a scan signal sharply dropping from the first driving voltage Vref to the third driving voltage −Vs is supplied to a scan electrode.

Figure 4M:
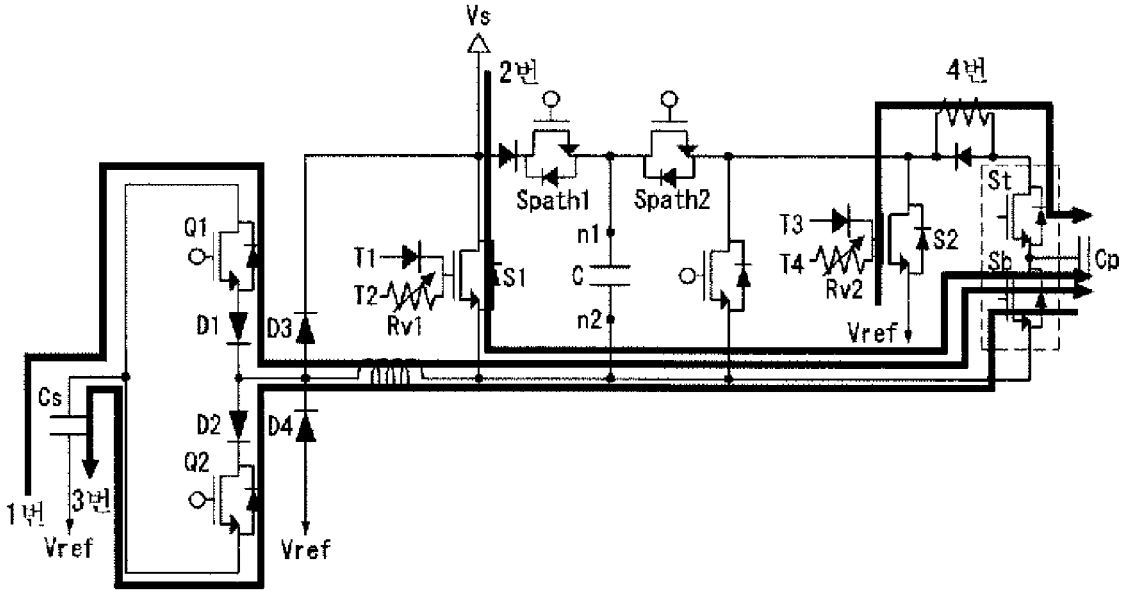

Referring to FIG. 4M, the energy storage capacitor Cs, the first switch Q1, and the inductor L of the energy recovery circuit 310, and the bottom switch Sb of the scan driver 350 are connected to each other along a first path, the voltage source supplying the second driving voltage Vs, the first switch S1 of the first signal generator 320, and the bottom switch Sb of the scan driver 350 are connected to each other along a second path, the bottom switch Sb of the scan driver 350, the inductor L, the second switch Q2, and the energy storage capacitor Cs of the energy recovery circuit 310 are connected to each other along a third path, and the second switch S2 of the second signal generator 330 and the top switch St of the scan driver 350 are connected to each other along a fourth path. The first, second, third, and fourth paths are made in the order thereof, so that a sustain signal is supplied to a scan electrode. The first switch S1 in the second path is supplied with a turn-on control signal through the first input terminal T1. Further, the second switch S2 in the fourth path is supplied with a turn-on control signal through the third input terminal T3.

As described above, since the second driving voltage Vs supplied from a single voltage source may be provided as a driving signal in the exemplary embodiment, the structure of the scan driver may be simplified. A set-down pulse switch and a sustain down switch may be shared in use.

Meanwhile, the path shown in FIG. 4D is made to provide the reset signal supplied during the reset period of the second subfield SF2 shown in FIG. 2. Accordingly, a set-up signal gradually rising from the first driving voltage Vref to the second driving voltage Vs is supplied to a scan electrode.

Thereafter, the path shown in FIG. 4C is made during the second subfield SF2 shown in FIG. 2. Since the first driving voltage Vref is supplied to a scan electrode as a turn-on control signal is inputted through the third input terminal T3 of the second switch S2, the voltage of scan electrode sharply drops from the second driving voltage Vs to the first driving voltage Vref. Accordingly, the peak voltage of the set-up signal in the second subfield SF2 may be lower than the peak voltage of the set-up signal in the first subfield SF1.

After supply of the set-up signal during the second subfield SF2 shown in FIG. 2, the path shown in FIG. 4J is made. At this time, if a turn-on time of the second switch S2 is shorter than a turn-on time of the first subfield SF1, it is supplied to a scan electrode a set-down signal that falls to the fourth driving voltage −V4 having higher voltage level than that of the third driving voltage −Vs.

The exemplary embodiment may reduce manufacturing costs of a plasma display apparatus by driving the plasma display apparatus through a single power source.

Embodiments of the invention being thus described, it will be obvious that the same may be varied in many ways. Such variations are not to be regarded as a departure from the scope of the invention, and all such modifications as would be obvious to one skilled in the art are intended to be included within the scope of the following claims.

What is claimed is:

1. A plasma display apparatus comprising:

a plasma display panel configured to include a scan electrode, a sustain electrode, and a data electrode;

a scan driver configured to supply, during a first subfield: a pre-reset signal which falls from a ground-level voltage (GND) to a negative sustain voltage (−Vs) to the scan electrode, a first reset signal to the scan electrode after the pre-reset signal, a scan signal which falls from the ground-level voltage (GND) to the negative sustain voltage (−Vs) to the scan electrode after the first reset signal, and a sustain signal which rises from the ground-level voltage (GND) to the positive sustain voltage (Vs) to the scan electrode after the scan signal; and a sustain driver configured to supply, during the first subfield: a first signal which rises from the ground-level voltage (GND) to the positive sustain voltage (Vs) to the sustain electrode, a sustain bias signal which rises from the ground-level voltage (GND) to the positive sustain voltage (Vs) to the sustain electrode after the first signal, and the sustain signal which rises from the ground-level voltage (GND) to the positive sustain voltage (Vs) to the sustain electrode after the sustain bias signal, wherein the scan driver is further configured to supply, during a second subfield after the first subfield: a second reset signal to the scan electrode, the scan signal which falls from the ground-level voltage (GND) to the negative sustain voltage (−Vs) to the scan electrode after the second reset signal, and the sustain signal which rises from the ground-level voltage (GND) to the positive sustain voltage (Vs) to the scan electrode after the scan signal, wherein the sustain driver is further configured to supply, during the second subfield: the sustain bias signal which rises from the ground-level voltage (GND) to the positive sustain voltage (Vs) to the sustain electrode, and the sustain signal which rises from the ground-level voltage (GND) to the positive sustain voltage (Vs) to the sustain electrode after the sustain bias signal, wherein the first reset signal includes: a first setup signal which rises from the ground-level voltage (GND) to the positive sustain voltage (Vs), a second setup signal which rises from the sustain voltage (Vs) to a voltage that is twice a magnitude of the positive sustain voltage (2Vs), and a first set-down signal which falls from the sustain voltage (Vs) to the negative sustain voltage (−Vs), wherein the second reset signal includes: a setup signal which rises from the ground-level voltage (GND) to the positive sustain voltage (Vs), and a second set-down signal which falls from the ground level voltage (GND) to the negative sustain voltage (−Vs), wherein the sustain driver is configured to supply the first signal at a time that at least partially overlaps a time at which the scan driver is configured to supply the pre-reset signal, and wherein, during the first subfield, the sustain driver is configured to supply the sustain bias signal at a time that at least partially overlaps a time at which the scan driver is configured to supply the scan signal and the first set-down signal, and, during the second subfield, the sustain driver is configured to supply the sustain bias signal at a time that at least partially overlaps a time at which the scan driver is configured to supply the second set-down signal.

2. The plasma display apparatus as in claim 1, wherein the scan driver includes:

an energy recovery circuit configured to recover a charged voltage of the scan electrode;

a driving unit including a top switch and a bottom switch, a first node between the top switch and the bottom switch being connected with the scan electrode;

a first switch disposed between the bottom switch and a sustain voltage source providing the sustain voltage, a second node between the bottom switch and the sustain voltage source being connected with the energy recovery circuit;

a first path switch disposed between the top switch and a third node between the first switch and the sustain voltage source;

a second path switch disposed between the first path switch and the top switch;

a third path switch disposed between the second node and a fourth node between the second path switch and the top switch;

a first capacitor disposed between the second node and a fifth node between the first path switch and the second path switch; and a second switch disposed between a ground-level voltage source and the fourth node.

3. The plasma display apparatus as in claim 2, wherein the energy recovery circuit includes:

a second capacitor disposed between the ground-level voltage source and the second node;

an inductor disposed between the second capacitor and the second node;

a third switch disposed between the second capacitor and the inductor; and a fourth switch disposed between a sixth node between the second capacitor and the third switch and a seventh node between the inductor and the third switch parallel to the third switch.

4. The plasma display apparatus as in claim 3, wherein the energy recovery circuit further includes a first diode disposed between third node and the seventh node, and a second diode disposed between the seventh node and the ground level voltage source, wherein an anode of the first diode is connected to the seventh node and a cathode of the second diode is connected to the seventh node.

5. The plasma display apparatus as in claim 2, wherein:

the scan driver further includes a diode disposed between the third node and the first path switch, an anode of the diode being connected to the third node.

6. The plasma display apparatus as in claim 2, wherein the scan driver further includes a first variable resistor connected to an input terminal of the first switch and a second variable resistor connected to an input terminal of the second switch.

7. The plasma display apparatus as in claim 1, further including a data driver configured to supply a data signal corresponding to the scan signal to the data electrode.

8. The plasma display apparatus as in claim 1, wherein the scan driver is configured to supply the second set-down signal of the second reset signal immediately after supplying the setup signal of the second reset signal.

* * * * *